US007992683B2

(12) United States Patent
Stephens

(10) Patent No.: US 7,992,683 B2
(45) Date of Patent: Aug. 9, 2011

(54) MULTIPURPOSE SAWHORSE END FRAME

(76) Inventor: Kenneth S. Stephens, Redding, CA (US)

( * ) Notice: Subject to any disclaimer, the term of this patent is extended or adjusted under 35 U.S.C. 154(b) by 376 days.

(21) Appl. No.: 12/078,028

(22) Filed: Mar. 26, 2008

(65) Prior Publication Data

US 2008/0236946 A1 Oct. 2, 2008

Related U.S. Application Data

(60) Provisional application No. 60/907,196, filed on Mar. 26, 2007.

(51) Int. Cl.
*E04G 1/00* (2006.01)

(52) U.S. Cl. ..... 182/186.5; 182/186.4; 182/181.1; 182/151

(58) Field of Classification Search ..... 182/186.5, 182/186.4, 181.1, 151
See application file for complete search history.

(56) References Cited

U.S. PATENT DOCUMENTS

| | | | | | |
|---|---|---|---|---|---|
| 1,101,610 | A | | 6/1914 | Allard | |
| 1,272,151 | A | * | 7/1918 | Torp | 144/286.1 |
| 1,340,370 | A | * | 5/1920 | Boze | 248/167 |
| 2,272,957 | A | | 2/1942 | Walp | |
| 2,400,659 | A | * | 5/1946 | St-Mars | 182/119 |
| 2,416,950 | A | * | 3/1947 | Pohrman | 182/119 |
| 2,634,172 | A | * | 4/1953 | Hollidge | 182/186.4 |
| 2,897,013 | A | * | 7/1959 | Delp | 52/645 |
| 2,911,265 | A | * | 11/1959 | Hannah | 182/186.5 |
| 3,035,660 | A | * | 5/1962 | Leon | 182/186.5 |
| 3,605,945 | A | * | 9/1971 | Knuth | 182/151 |
| 3,763,958 | A | * | 10/1973 | Hanson | 182/186.5 |
| 3,809,183 | A | * | 5/1974 | Lowd et al. | 182/186.1 |
| D245,105 | S | | 7/1977 | Rader | |
| 4,124,093 | A | * | 11/1978 | Breisch | 182/186.5 |
| 4,241,808 | A | | 12/1980 | Middleton et al. | |
| 4,248,326 | A | * | 2/1981 | Hansen et al. | 182/186.1 |
| 4,394,005 | A | * | 7/1983 | Stewart | 256/64 |
| 4,433,753 | A | * | 2/1984 | Watson | 182/151 |
| 4,570,915 | A | | 2/1986 | O'Hern | |
| 4,700,986 | A | * | 10/1987 | Davis et al. | 297/158.5 |
| 5,012,893 | A | * | 5/1991 | Kraeger | 182/153 |
| 5,224,753 | A | * | 7/1993 | Fox | 297/158.5 |
| 5,351,730 | A | | 10/1994 | Lewellen et al. | |
| 5,427,200 | A | * | 6/1995 | Yemini | 182/153 |
| 5,526,897 | A | | 6/1996 | Schiller | |
| 5,582,267 | A | * | 12/1996 | Bockoven et al. | 182/153 |
| 5,678,655 | A | * | 10/1997 | Bearden | 182/182.1 |
| 6,007,147 | A | * | 12/1999 | McCracken | 297/158.5 |
| D493,236 | S | | 7/2004 | Frey | |
| 2004/0016600 | A1 | | 1/2004 | Austin et al. | |
| 2008/0105492 | A1 | * | 5/2008 | Maxson | 182/151 |

* cited by examiner

*Primary Examiner* — Katherine Mitchell
*Assistant Examiner* — Candace L Bradford
(74) *Attorney, Agent, or Firm* — Richard C. Litman

(57) ABSTRACT

The multipurpose sawhorse end frame has a top section defining center and lateral slots for receiving 2"×4" beams and central slots for 2"×12" planks, a central section with center slots for receiving 2"×4" beams and lateral support bars for supporting 2"×12" planks, and a bottom section having feet for supporting the frame. A plurality of diagonal braces maintain rigidity of the end frame and provide the end frame with structural strength. Two or more end frames may be configured as a sawhorse, a scaffold, a workbench, a table, or other temporary construction accessory using scrap lumber and without fasteners. The multipurpose sawhorse end frame may be made from lightweight aluminum or other suitable material.

10 Claims, 8 Drawing Sheets

MULTIPURPOSE SAWHORSE END FRAME

CROSS-REFERENCE TO RELATED APPLICATION

This application claims the benefit of U.S. Provisional Patent Application Ser. No. 60/907,196, filed Mar. 26, 2007.

BACKGROUND OF THE INVENTION

1. Field of the Invention

The present invention relates to construction tools, and more particularly to a multipurpose sawhorse end frame that can be configured into a sawhorse, scaffolding, workbench, table, or other temporary structure.

2. Description of the Related Art

During the construction of buildings or other projects, it is often necessary to support boards so that the boards can be cut with a portable saw, such as a jig saw or portable circular saw. Similarly, it may become necessary to use scaffolding so that the construction worker can reach windows, roof gutters, and the like from the exterior of the building or other structure. The construction worker may also find a workbench or table useful for supporting tools, boards, fasteners, and other tools or workpieces that may be required during the construction project.

The transport and setup of so many accessories can become both burdensome and time-consuming. Therefore, there is a need for a single accessory that can be configured into any of the desired accessories with the use of boards or scrap lumber that would otherwise be disposed of, and which can be quickly set up and broken down for compact storage and transport. Thus, a multipurpose sawhorse end frame solving the aforementioned problems is desired.

SUMMARY OF THE INVENTION

The multipurpose sawhorse end frame has a top section defining center and lateral slots for receiving 2"×4" beams and central slots for 2"×12" planks, a central section with center slots for receiving 2"×4" beams and lateral support bars for supporting 2"×12" planks, and a bottom section having feet for supporting the frame. A plurality of diagonal braces maintain rigidity of the end frame and provide the end frame with structural strength. Two or more end frames may be configured as a sawhorse, a scaffold, a workbench, a table, or other temporary construction accessory using scrap lumber and without fasteners. The multipurpose sawhorse end frame may be made from lightweight aluminum or other suitable material.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
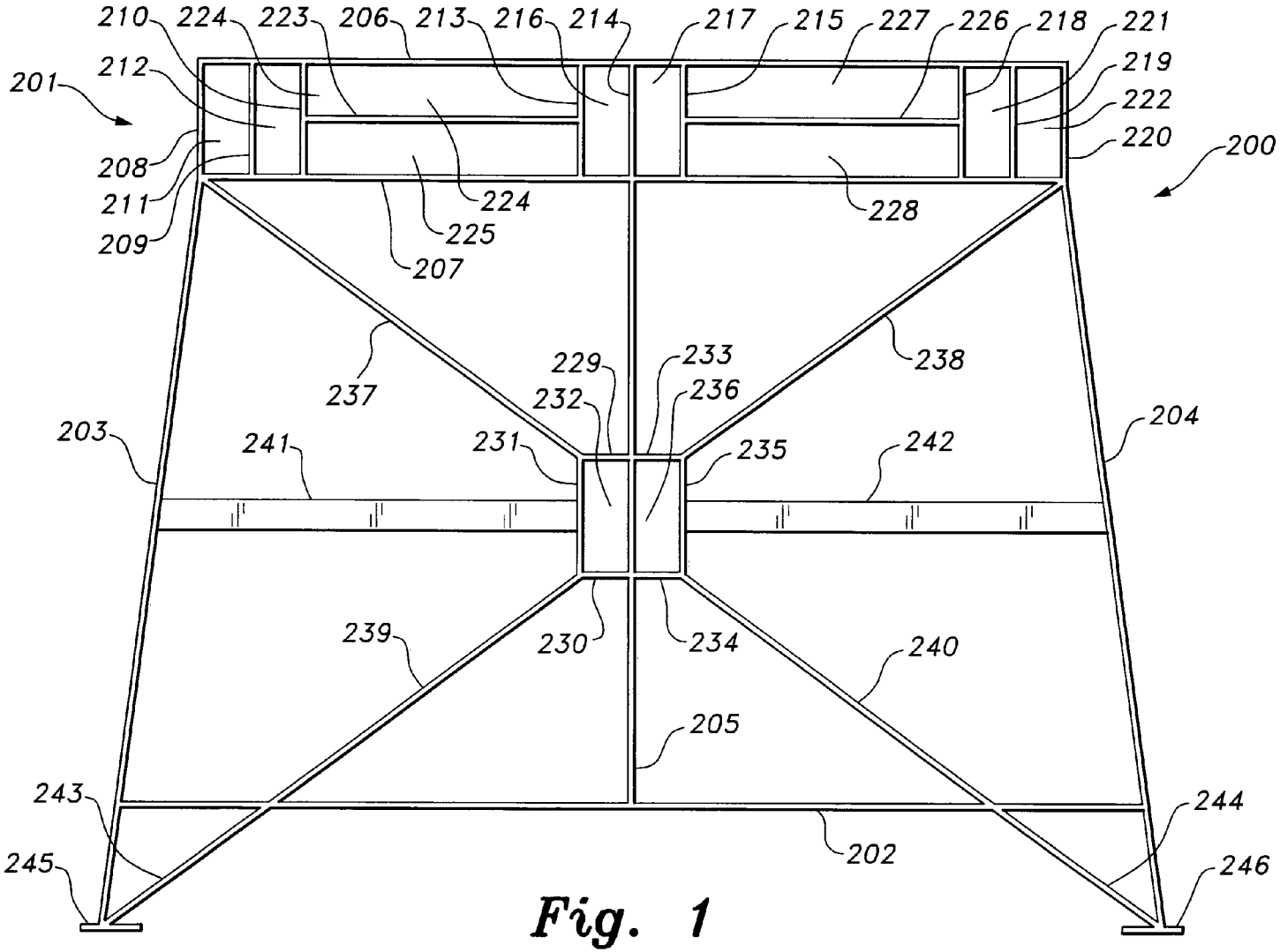
FIG. 1 is front view of a multipurpose sawhorse end frame according to the present invention.

The present invention is a multipurpose sawhorse end frame that can be easily assembled or disassembled and reconfigured for a variety of purposes. A sawhorse or trestle can be erected using a pair of the end frames 200, which are constructed from ¼"×2" aluminum stock, and scrap lumber for the beams. As best seen in FIG. 1, the end frame 200 has a top section 201 having an elongated horizontal top bar 206 and an elongated horizontal bottom bar 207. Vertical bars 208, 209 and 210 are welded to the top bar 206 and bottom bar 207 at a first end to form a first pair of lateral slots 211 and 212 for receiving 2"×4" beams. Vertical bars 213, 214 and 215 are welded to middle portion of the top bar 206 and bottom bar 207 to form a pair of center slots 216 and 217 for receiving 2"×4" beams. Vertical bars 218, 219 and 220 are welded to the second end of top bar 206 and bottom bar 207 to form another pair of lateral slots 221 and 222 for receiving 2"×4" beams.

A horizontal bar 223 is welded to vertical bars 210 and 213 to form a pair of central slots 224 and 225, respectively, for receiving 2"×12" planks. Another horizontal bar 226 is welded to vertical bars 215 and 218 to form another pair of central slots 227 and 228, respectively, for receiving 2"×12" planks.

A first leg bar 203 is welded at its upper end to the first end of the top section 201 and welded at a lower end to a diagonal brace 243. A second leg bar 204 is welded at an upper end to the second end of the top section 201 and welded at a lower end to a diagonal brace 244. An elongate base bar 202 is welded at a first end to a lower portion of first leg bar 203 a predetermined distance from diagonal brace 243. Base bar 202 is welded at a second end to a lower portion of second leg bar 204 a predetermined distance from diagonal brace 244. Base bar 202 is longer than the top section 201 so that leg bars 203 and 204 extend outwardly at a slight angle.

A vertical center bar 205 is welded at an upper end to the center of bottom bar 207 of top section 201 and welded at a lower end to the center of base bar 202. A top wall 229 and bottom wall 230 are welded to a sidewall 231 and to the center bar 205 adjacent the center of the center bar 205 to form a center slot 232 in a central section of the end frame 200 for receiving a 2"×4" beam. A top wall 233 and bottom wall 234 are welded to a sidewall 235 and to the center bar 205 adjacent the center of the center bar 205 to form a second center slot 236 in the central section for receiving a second 2"×4" beam.

A top end of a first diagonal brace bar 237 is welded to a first end of bottom bar 207. A bottom end of first diagonal brace bar 237 is welded to one end of top wall 229. A top end of a second diagonal brace bar 238 is welded to a second end of bottom bar 207. A bottom end of second diagonal brace bar 238 is welded to one end of top wall 233. A top end of a third diagonal brace bar 239 is welded to one end of bottom wall 230. A bottom end of brace bar 239 is welded to base bar 202 adjacent to a first end of the base bar 202. A top end of a fourth diagonal brace bar 240 is welded to one end of bottom wall 234. A bottom end of brace bar 240 is welded to the base bar 202 adjacent to a second end of the base bar 202.

Fifth diagonal brace 243 is welded at a top end to the base bar 202 adjacent to the first end of the base bar 202 and welded at a bottom end to the center of footplate 245 in the bottom section of the end frame 200. Sixth diagonal brace bar 244 is welded at a top end to the base bar 202 adjacent the second end of base bar 202 and welded at a bottom end to the center of footplate 246.

A first horizontal support bar 241 is welded at a first end to a center portion of first leg bar 203 and welded at a second end to the center of sidewall 231. A second horizontal support bar 242 is welded at a first end to the center of sidewall 235 and welded at a second end to a center portion of second leg bar 204.

Figure 2:
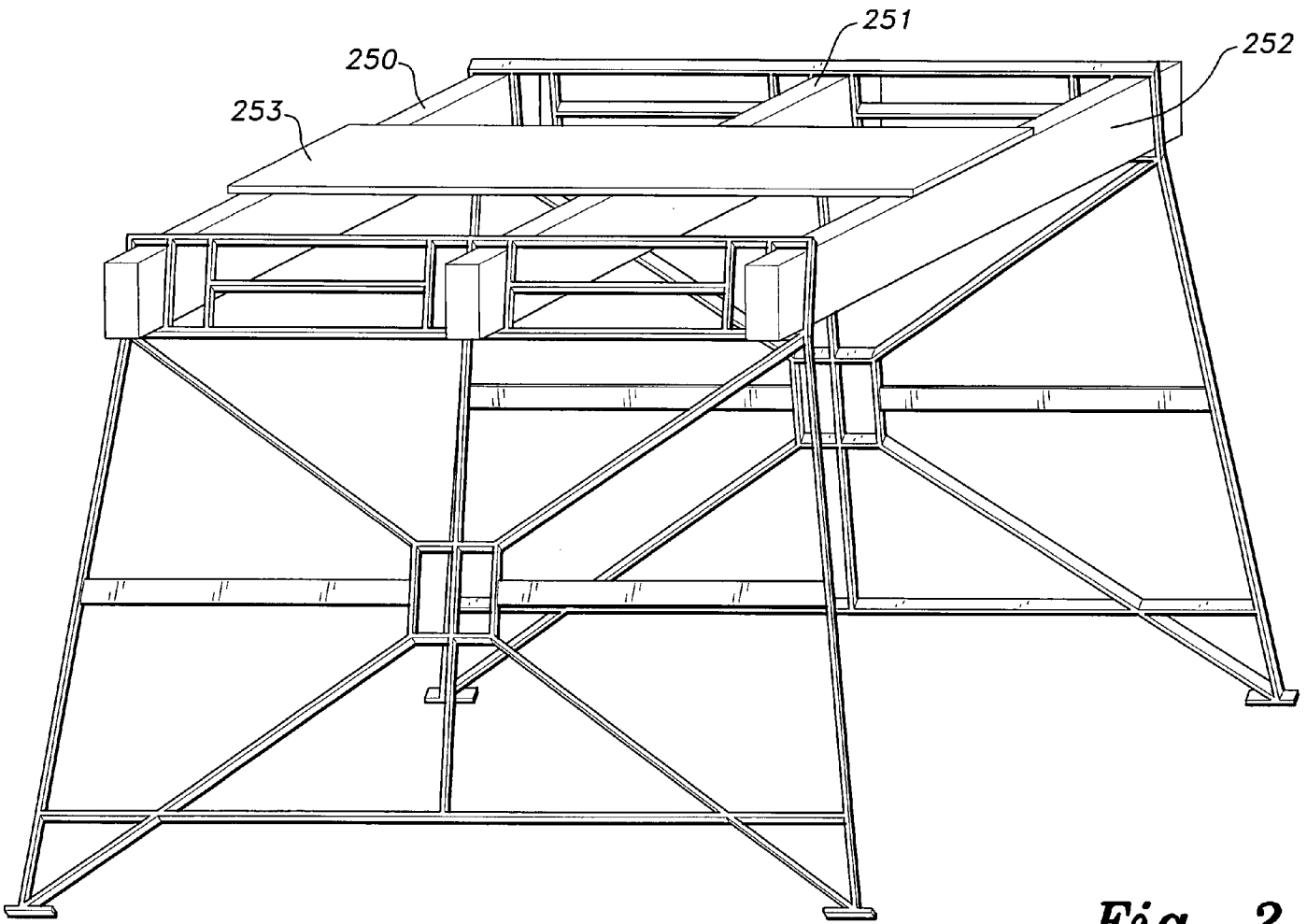
FIG. 2 is an environmental perspective view of a pair of multipurpose sawhorse end frames according to the present invention configured as a sawhorse with center support.

To configure the end frame 200 as a sawhorse with a center support, a pair of end frames 200 are provided with 2"×4" beams in slots 210, 211, 216, 217, 221 and 222, as best seen in FIG. 2. A panel 253 may be supported upon the planks, either as a workpiece or to serve as the worktop.

Figure 3:
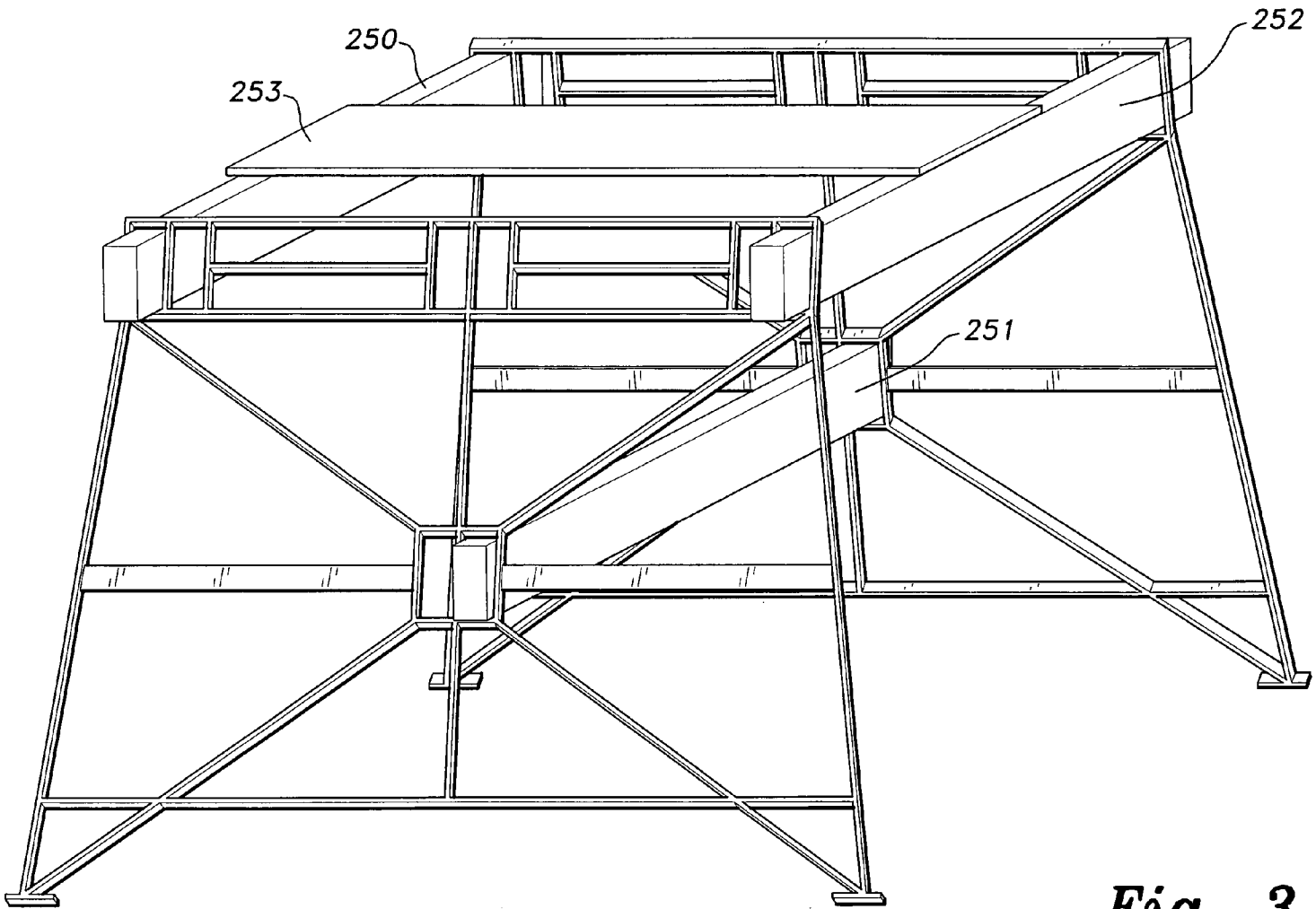
FIG. 3 is an environmental perspective view of a pair of the multipurpose sawhorse end frames according to the present invention configured as a sawhorse.

In FIG. 3, the end frames 200 are shown configured as a sawhorse, trestle, or for light duty scaffolding, where the 2"×4" beams are placed in slots 211, 222 and 235. Panel 253 may be placed upon the upper sawhorse to serve as a scaffold.

Figure 4:
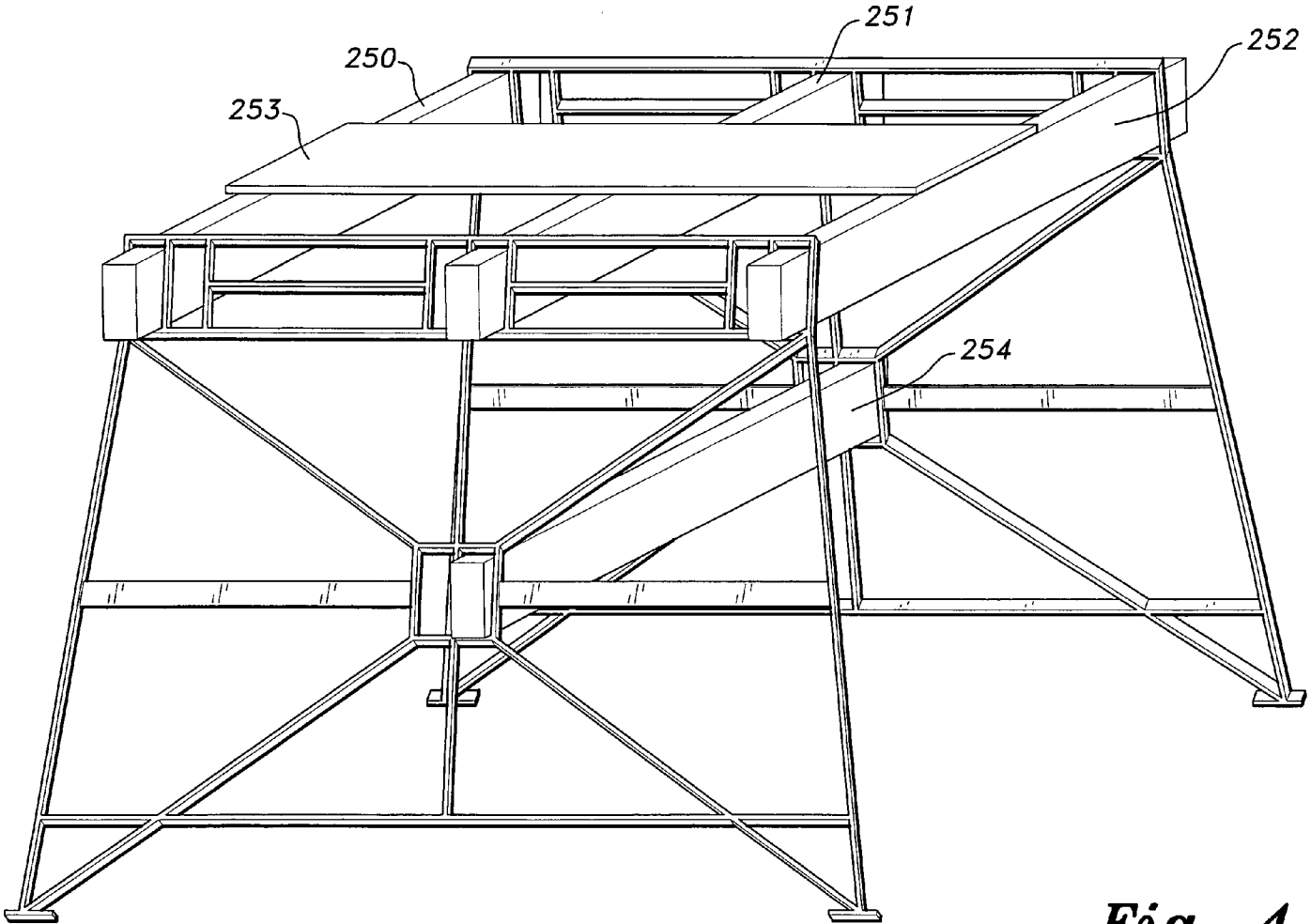
FIG. 4 is an environmental perspective view of a pair of the multipurpose sawhorse end frames according to the present invention configured as a mid-duty scaffold.

FIG. 4 shows the sawhorse end frames 200 configured for medium-duty scaffolding. Beam 250 is place in slot 211, beam 251 is placed in slot 217, beam 252 is placed in slot 222 and beam 254 is placed in slot 236. Panel 253 is placed upon the upper planks to serve as the scaffold platform.

Figure 5:
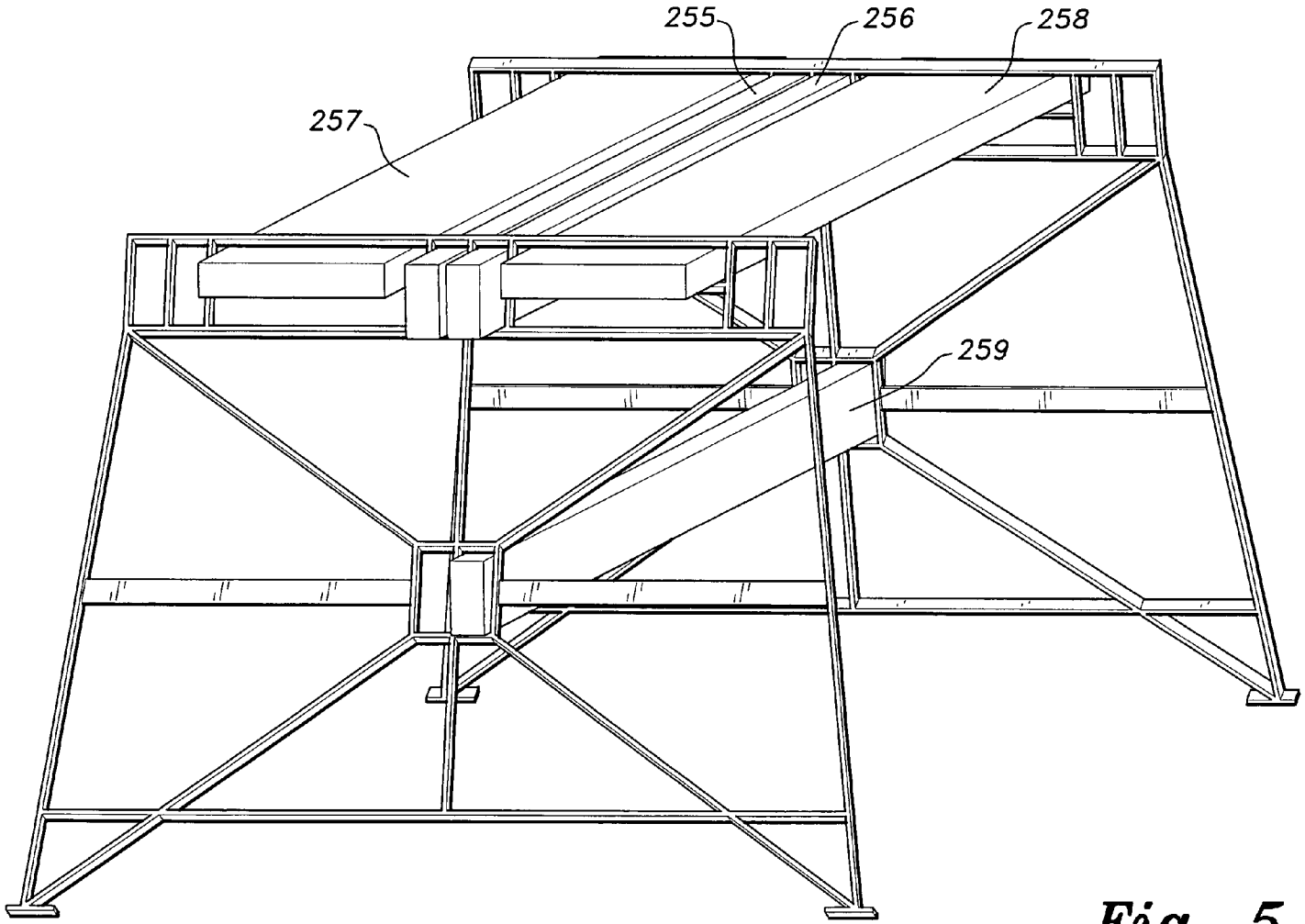
FIG. 5 is an environmental perspective view of a pair of the multipurpose sawhorse end frames according to the present invention configured as a heavy-duty scaffold.

In FIG. 5, beam 255 is placed into slots 216 of a pair of end frames 200, beam 256 is placed in slots 217, beam 259 is placed in slots 232, while 2"×12" plank 257 is placed in slots 224 and 2"×12" plank 258 is placed in slots 227 to form a heavy duty scaffold.

Figure 6:
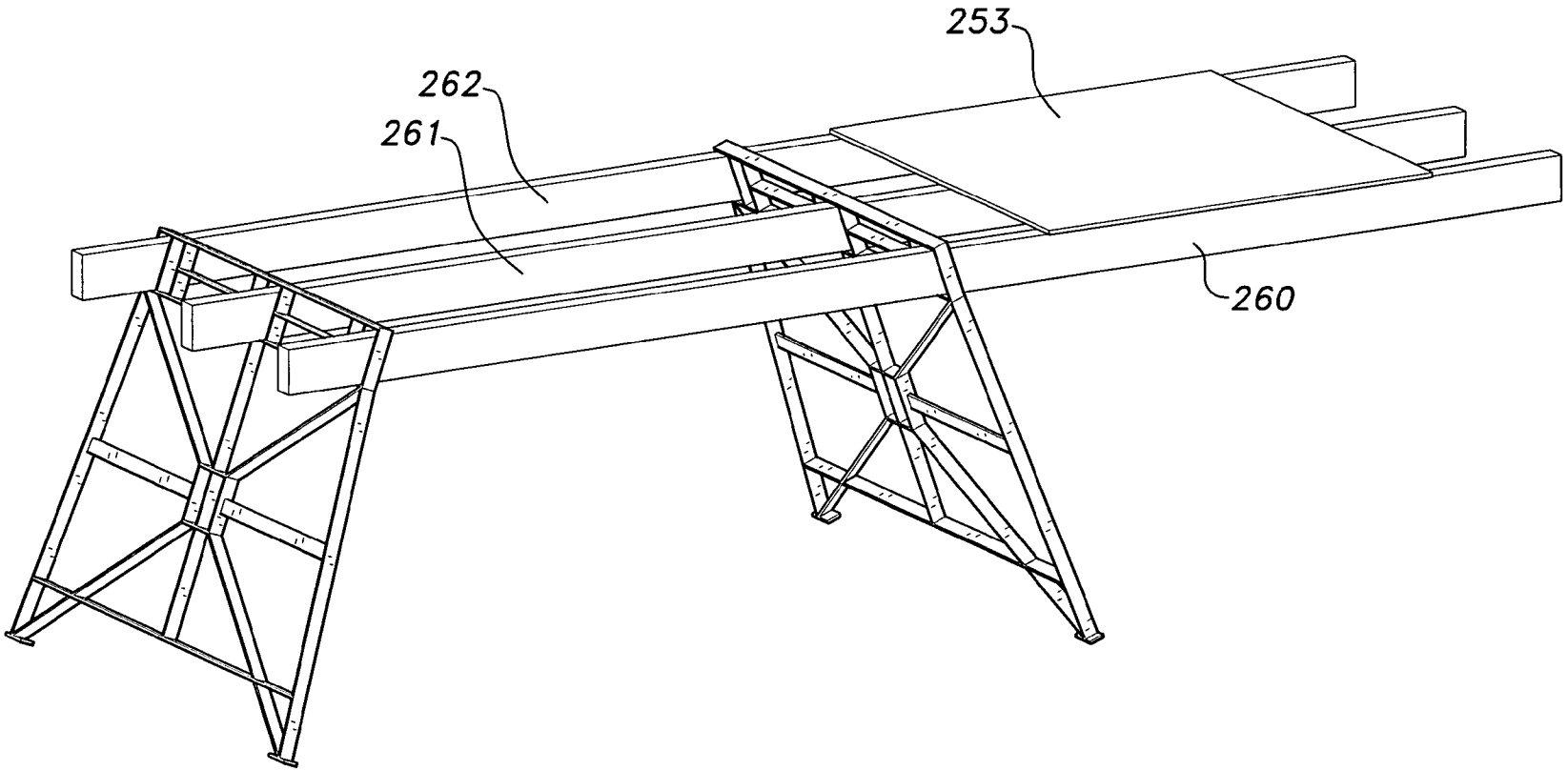
FIG. 6 is an environmental perspective view of a pair of the multipurpose sawhorse end frames according to the present invention configured as a cantilever work support.

In FIG. 6, 2"×4" beams 260,261 and 262 are passed through slots 211, 217 and 222, respectively, of a pair of end frames 200 and a panel is place on the extended portion of the planks to form a cantilevered work support.

Figure 7:
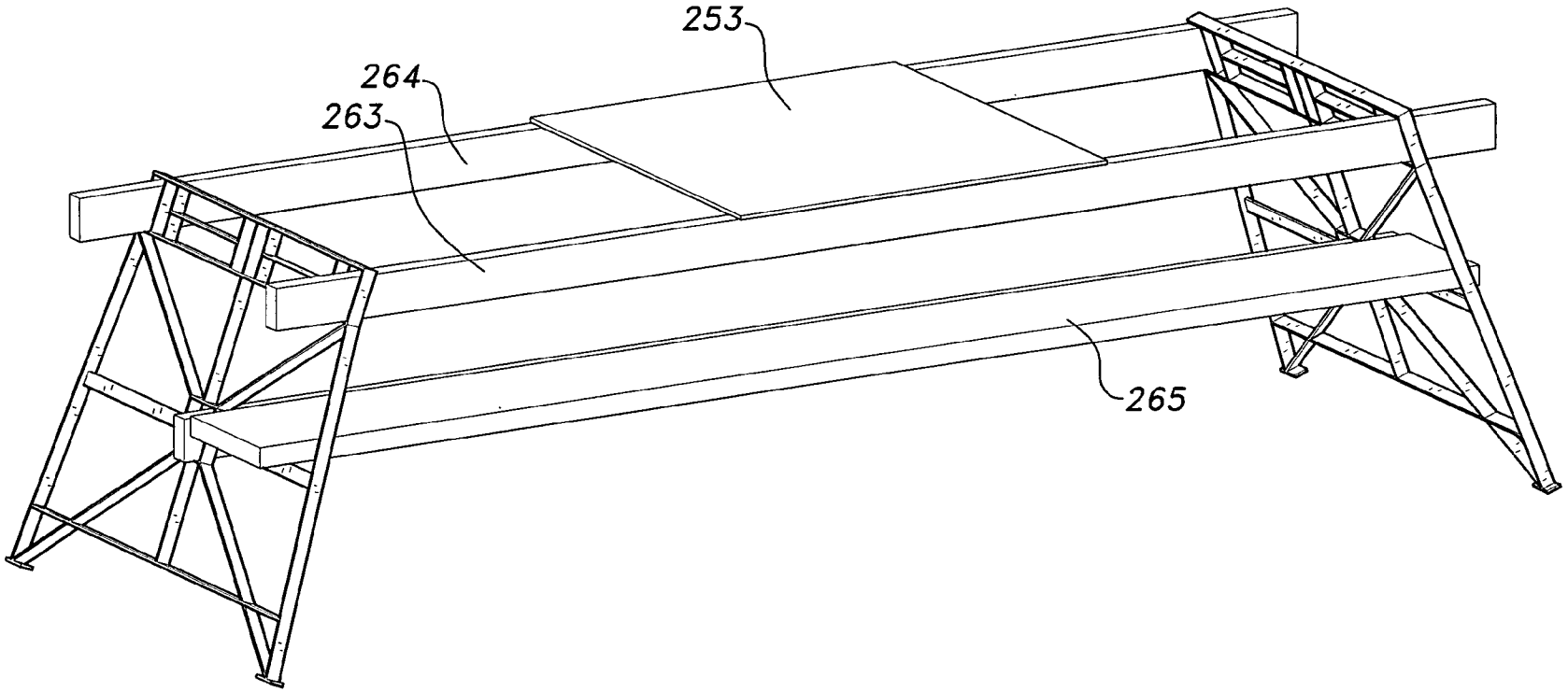
FIG. 7 is an environmental perspective view of a pair of the multipurpose sawhorse end frames according to the present invention configured as a worktop with seat.

In FIG. 7, 2"×4" beams 264 and 265 are placed in slots 211 and 222. A panel 253 is place upon the beams 264 and 265 to serve as a worktop. A 2"×12" plank is laid across horizontal support bars 242 to serve as a tool storage area.

Figure 8:
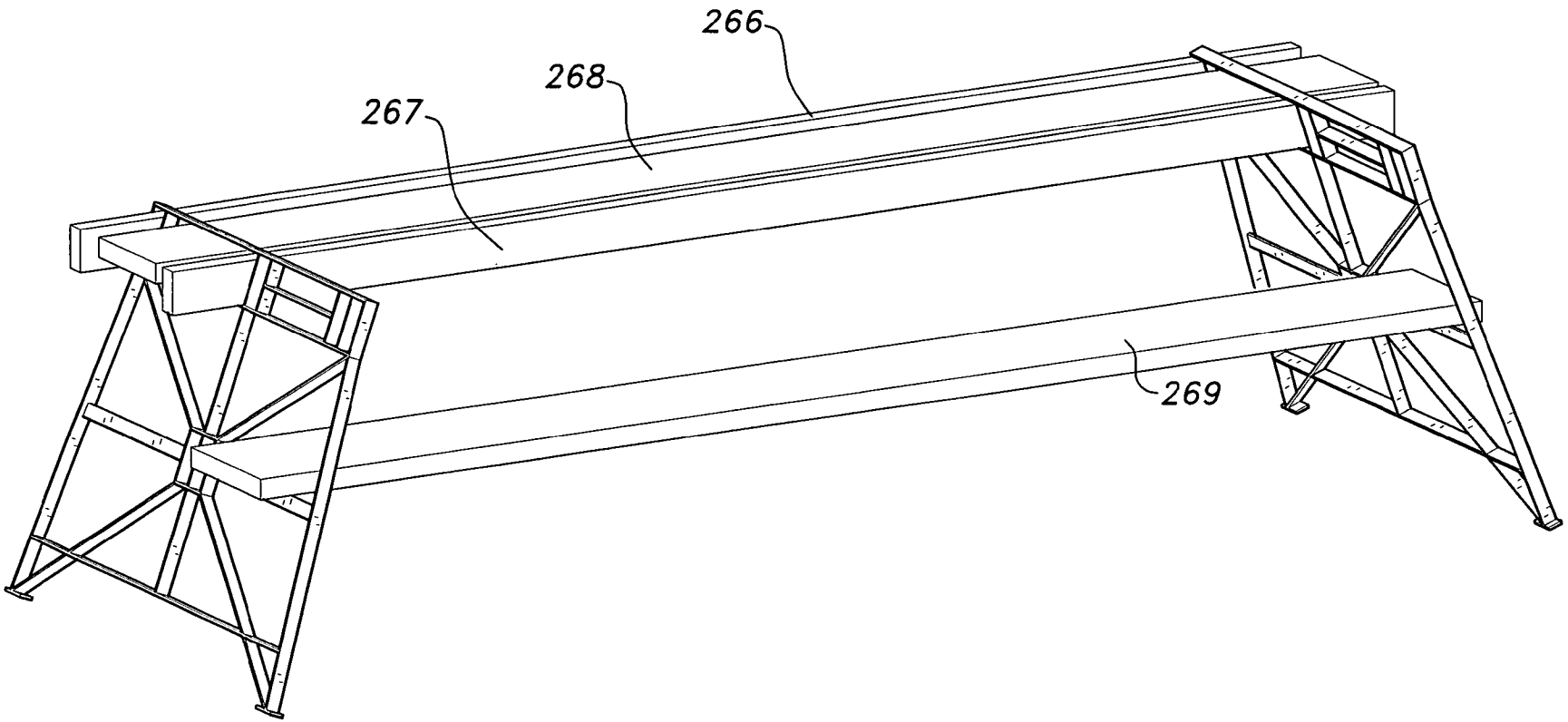
FIG. 8 is an environmental perspective view of a pair of the multipurpose sawhorse end frames according to the present invention configured as a two-stage scaffold or workbench with seat.

In FIG. 8, 2"×4" beams 266 and 267 are placed in slots 212 and 216, respectively, and a 2"×12" plank 268 is placed in slots 224. A 2"×12" plank 269 is laid across horizontal support bars 242. In this configuration the sawhorse end frames 200 serve as a two-stage scaffold or a tabletop and bench for an eating area.

It will be noted that the provision of side-by-side or double slots 210 and 211, 216 and 217, 221 and 222, and 232 and 236 effective allow two 2"×4" beams to placed side-by-side whenever a 4"×4" beam is needed to support a load. It will be noted that the recitation of particular dimensions is exemplary, and not by way of limitation. In particular, the end frame may have slots dimensioned to accommodate, e.g., 2"×6" beams and planks from 2"×8" to 2"×12", if desired.

It is to be understood that the present invention is not limited to the embodiment described above, but encompasses any and all embodiments within the scope of the following claims.

I claim:

1. A multipurpose sawhorse end frame, comprising:

a top section, comprising:

a substantially rectangular outer frame member, said substantially rectangular outer frame member being elongated and extending along a horizontal direction and being defined by horizontally aligned top and bottom bars and opposing vertical side members;

two pairs of end frame members formed within said substantially rectangular outer frame member and defining vertically oriented lateral slots and being respectively positioned at longitudinally opposed ends of said substantially rectangular outer frame member thereby defining said opposing vertical side members, wherein each said lateral slots has a substantially elongated rectangular contour extending along a vertical direction, whereby vertically oriented beam ends are accommodated within the lateral slots;

at least one central frame member formed substantially centrally within said substantially rectangular outer frame member and defining a pair of center slots, wherein each of said center slots has a substantially elongated rectangular contour extending along the vertical direction, whereby vertically oriented beam ends are accommodated within said center slots; and at least a pair of median frame members being formed within said substantially rectangular outer frame member and defining central slots and being respectively positioned between said at least one pair of end lateral slots on either side of the at least one pair of center slots, wherein each said central slot has a substantially elongated rectangular contour extending along the horizontal direction, whereby horizontally oriented plank ends are accommodated within the central slots;

a central section having at least one substantially elongated, rectangularly contoured and vertically extending frame member;

a bottom section having a pair of feet;

a pair of end members joining the top, central and bottom sections; and a plurality of diagonal braces disposed between the top, central and bottom sections.

2. The multipurpose sawhorse end frame according to claim 1, wherein said end members gradually slope outward from the side members of said top section in order to provide a stable base for the end frame.

3. The multipurpose sawhorse end frame according to claim 1, wherein said top section comprises a first pair of parallel bars extending between the top bar and the bottom bar adjacent one of the side members, and a second pair of parallel bars extending between the top bar and the bottom bar adjacent the opposing side member in order to define the first and second pairs of vertically aligned lateral slots.

4. The multipurpose sawhorse end frame according to claim 3, wherein said top section comprises three parallel bars extending between the top bar and the bottom bar, the three parallel bars being spaced apart from and centrally located between the first and second pairs of parallel bars in order to define the pair of vertically aligned central slots.

5. The multipurpose sawhorse end frame according to claim 4, wherein said top section comprises a first horizontal bar extending between the first pair of parallel bars and the three parallel bars, and a second horizontal bar extending between the second pair of parallel bars and the three parallel bars in order to define the horizontally aligned central slots on opposite sides of the three parallel bars.

6. The multipurpose sawhorse end frame according to claim 1, wherein said central section comprises a top wall, a bottom wall, and a pair of opposing sidewalls joined to the top and bottom walls to define a rectangular center frame, and a center bar extending between said top section and said bottom section, the center bar bisecting the rectangular center frame to define the pair of vertically aligned center slots of said central section.

7. The multipurpose sawhorse end frame according to claim 1, wherein said bottom section comprises a base bar extending between said pair of end members, the base bar having a length greater than said top section, whereby said end members slope outwardly.

8. The multipurpose sawhorse end frame according to claim 7, further comprising diagonal brace members extending between said base bar and an end of each of said end members, respectively.

9. The multipurpose sawhorse end frame according to claim 1, wherein said top section, said central section, said bottom section, said end members, and said diagonal braces are made from aluminum.

10. A sawhorse formed from a pair of multipurpose sawhorse end frames according to claim 1, comprising:

first and second multipurpose sawhorse end frames according to claim 1; and top beams extending between a single one of each of the vertically aligned lateral slots and a single one of the vertically aligned center slots of said top sections of the first and second end frames, and a center beam extending between a single one of the vertically aligned center slots of said end frames.

* * * * *